United States Patent [19]

Kulischenko et al.

[11] 4,173,937

[45] Nov. 13, 1979

[54] REMOTELY ACTUATED MARINE STEERING SYSTEM

[75] Inventors: Walter Kulischenko, East Brunswick, N.J.; Martin J. Capdevielle, Staten Island, N.Y.

[73] Assignee: Pennwalt Corporation, Philadelphia, Pa.

[21] Appl. No.: 880,410

[22] Filed: Feb. 23, 1978

[51] Int. Cl.[2] ..... B63H 25/00

[52] U.S. Cl. ..... 114/144 R

[58] Field of Search ..... 114/144 R; 74/216.5, 74/501, 424.8

[56] References Cited

U.S. PATENT DOCUMENTS

| | | | |
|---|---|---|---|
| 2,397,312 | 3/1946 | Forrest | 74/216.5 |
| 3,206,998 | 9/1965 | Matz et al. | 114/144 R |

*Primary Examiner*—Stephen G. Kunin
*Assistant Examiner*—James B. Bechtel

[57] ABSTRACT

Simple and inexpensive steering mechanism for marine craft wherein motion from a manually-operated steering wheel controls a remotely disposed rudder or other steering member. The present invention is characterized by an absence of gear mechanisms after the steering wheel for "stepping-up" the number of revolutions from the steering wheel in order that the steering member may be moved into steering position without requiring an excessive number of steering wheel revolutions. In lieu of such gear mechanism, a pulley-belt device is employed. As in the prior art, the stepped-up revolutions are conventionally fed into a rotatable flexible shaft assembly; and a ball screw cylinder or the like converts the rotary motion of the stepped-up revolutions into linear motion of a member which controls the steering. Since the steering wheel controls the direction of rotation of each pulley used in the system, as well as the direction of rotation of the rotatable flexible shaft assembly and the screw in the ball screw cylinder, all of which rotate in the same direction, it becomes readily known whether a ball screw cylinder contains a right or left hand threaded screw member therein, thus facilitating aftermarket replacement of steering systems. With prior art gear mechanisms, this capability is not readily available.

3 Claims, 2 Drawing Figures

REMOTELY ACTUATED MARINE STEERING SYSTEM

STATEMENT OF THE INVENTION

This invention relates to marine steering systems and more particularly concerns remotely actuated steering systems for marine propulsion devices such as outboard motors, inboard motors, and stern drive units; and for remotely controlling rudders and similar steering members.

BACKGROUND OF THE INVENTION

Marine steering systems employing remotely actuated rotatable flexible shafts are known. These flexible means are basic elements of power transmission and are designed to transmit power or control from a driving element to an element to be driven, where direct coupling therebetween is impractical.

In known prior art marine steering systems of the class covered by this invention, the driving element is an output shaft of a device which has been appropriately "stepped-up" by suitable gearing mechanism. The stepped-up output is then fed into a rotatable flexible shaft. The driven element is usually a device which is capable of converting rotary motion from the rotatable flexible shaft to linear motion, and may comprise a ball screw cylinder, threaded screw, or the like. The linear motion is transmitted to a convenient output member which operates or controls the rudder or other steering mechanism.

Gear mechanisms used in marine steering systems are not smooth in operation, provide undesirable backlash, and are somewhat noisy, even when made from suitable non-metallic materials.

The present invention satisfies a long felt need. It overcomes each of the aforementioned deficiencies of the prior art by providing a pulley-belt arrangement or system in lieu of the prior art gear mechanism.

DETAILED DESCRIPTION OF THE INVENTION

Figure 1:
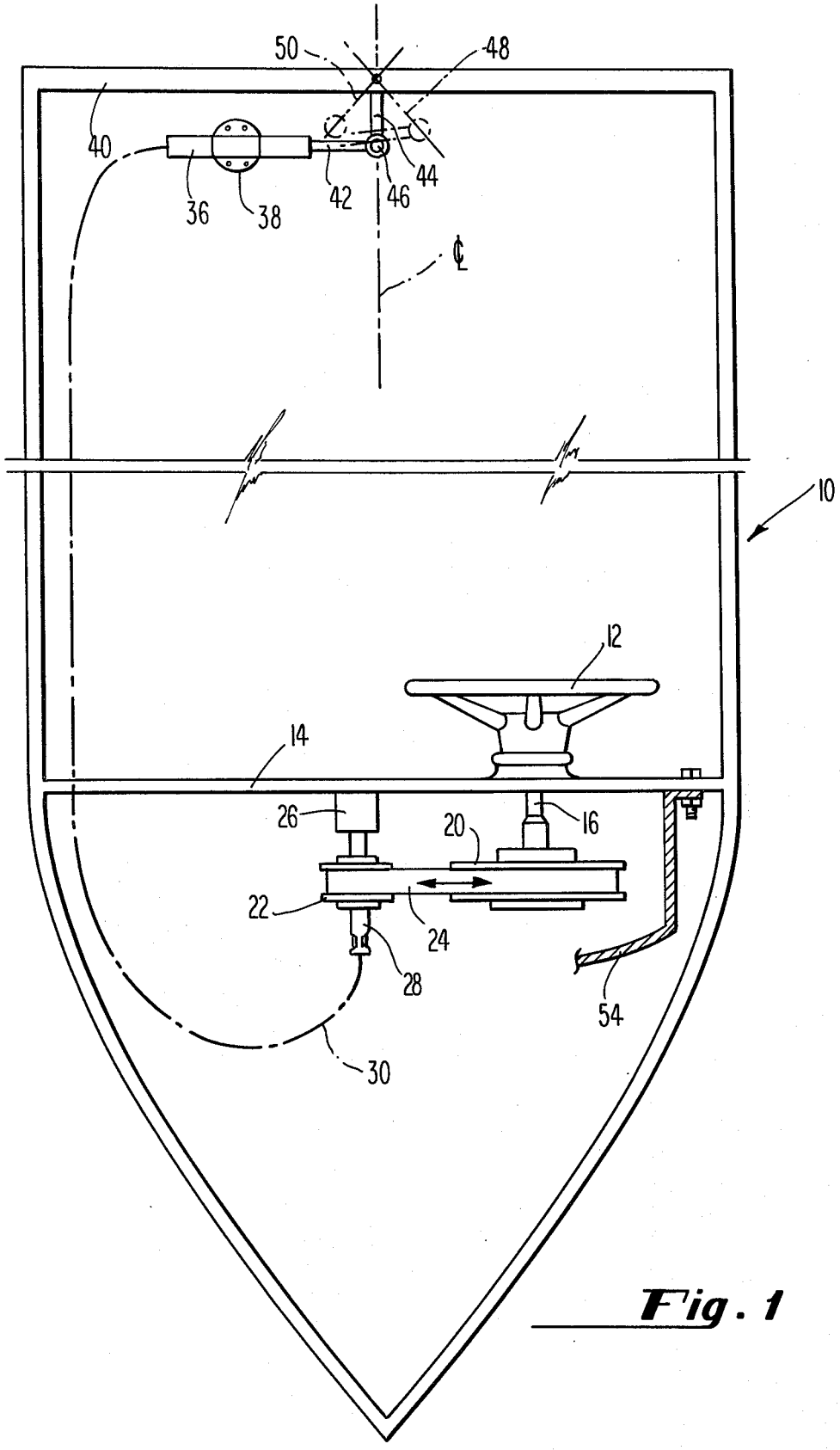
FIG. 1 is a plan view, partially sectioned, of the remotely actuated steering mechanism of the present invention for use with marine vessels or craft.

In FIG. 1, a boat 10 includes a manually operated steering wheel 12 which may be conveniently mounted to dashboard 14. Steering wheel shaft 16 is connected by conventional means to a driver pulley 20 such that one revolution of steering wheel 12 produces a similar revolution of the driver pulley. Driver pulley 20 causes driven pulley 22 to rotate therewith by virtue of a timing belt 24 operably engaged therebetween. Driven pulley 22 is provided with a smaller diameter than driver pulley 20, and thus, a single revolution of the driver pulley will produce a plurality of revolutfons of the driven pulley. In the present invention, one complete revolution of steering wheel 12, or driver pulley 20, will cause 4 revolutions of driven pulley 22. The ratio of diameters of the pulleys to achieve these values is readily calculable and is not stated herein.

Driven pulley 22 is journalled, or suitably rotatably mounted to dashboard 14 by pivot bearing 26, for example.

Shaft 28 of driven pulley 22 is connected to rotatable flexible shaft assembly 30 which transmits torque from shaft 28 to a ball screw cylinder 36, secured by bracket 38 to boat 10 adjacent transom 40. The pulley-belt components may readily be enclosed in a self-contained unit, having means for connecting shaft 28 to rotatable flexible shaft assembly 30, which unit may be screw mounted to dashboard 14. Ball screw cylinder 36 is conventional and converts rotary motion from flexible rotatable shaft assembly 30 to linear motion, which linear motion is transmitted to an output member 42 for controlling a steering arm 44 through pivot link 46. Steering arm 44 moves the outboard motor (not shown) or a rudder or other steering member (also not shown) by conventional means.

Steering arm 44 is illustrated at its mid-travel position. Dotted lines 48 and 50 indicate the positions of steering arm 44 at its end-travel positions. More specifically, when steering wheel 12 is rotated about 1½ revolutions in a clockwise direction, or to the right, steering arm 44 will assume the position indicated by dotted lines 48 causing boat 10 to travel to the right. Thus, the screw in the ball screw cylinder of FIG. 1 must be provided with a left handed thread if boat 10 is to travel in a direction suggested by its steering wheel. As aforementioned, ball screw cylinder 36 is conventional and is not shown in detail, but typically comprises a nut, a screw which is rotatable relative to the nut, and a plurality of balls disposed in a closed loop around the inner periphery of the nut. The screw, of course, is free to rotate, but linear movement thereof is restrained. The nut how ever, connected to output member 42, is restrained from rotating and thus moves linearly as the screw is rotated.

Alternatively, dotted lines 50 indicate the position of steering arm 44 when steering wheel 12 is rotated about 1½ revolutions to the left, or counterclockwise, to thus cause boat 10 to travel to the left.

In a pulley-timing belt system, each pulley rotates in the same direction regardless of the number of pulleys used. However, if a timing belt having teeth on both sides thereof is employed, an output pulley suitably positioned in engaging relation therewith will rotate in an opposite direction. In the present invention, these pulleys will rotate in the same direction as the direction in which steering wheel 12 is rotated. Since it is desirable to have boat 10 travel in the same direction as wheel 12 is turned, attention must be given to the selection of a ball screw cylinder having a screw member therein which is threaded in the proper direction. Thus, if the ball screw cylinder 36 is mounted on the right, or starboard side, as shown in FIG. 1, a left handed screw member within ball screw cylinder 36 will be needed if steering arm 44 is to pivot the rudder or outboard motor such that direction of travel of boat 10 will be consistent with the direction of rotation of steering wheel 12.

In those instances where the ball screw cylinder is mounted on the port side, and not on the starboard side as shown in the drawing, a ball screw cylinder containing a screw member provided with threads of the opposite pitch will be selected. Notwithstanding, the present invention facilitates aftermarket servicing of marine steering systems of the class herein described by providing readily available information to a repairman, or owner of the marine vessel, regarding proper ball screw cylinder replacement. The present invention becomes even more significant when one considers the increasing number of pleasure craft now in use.

Figure 2:
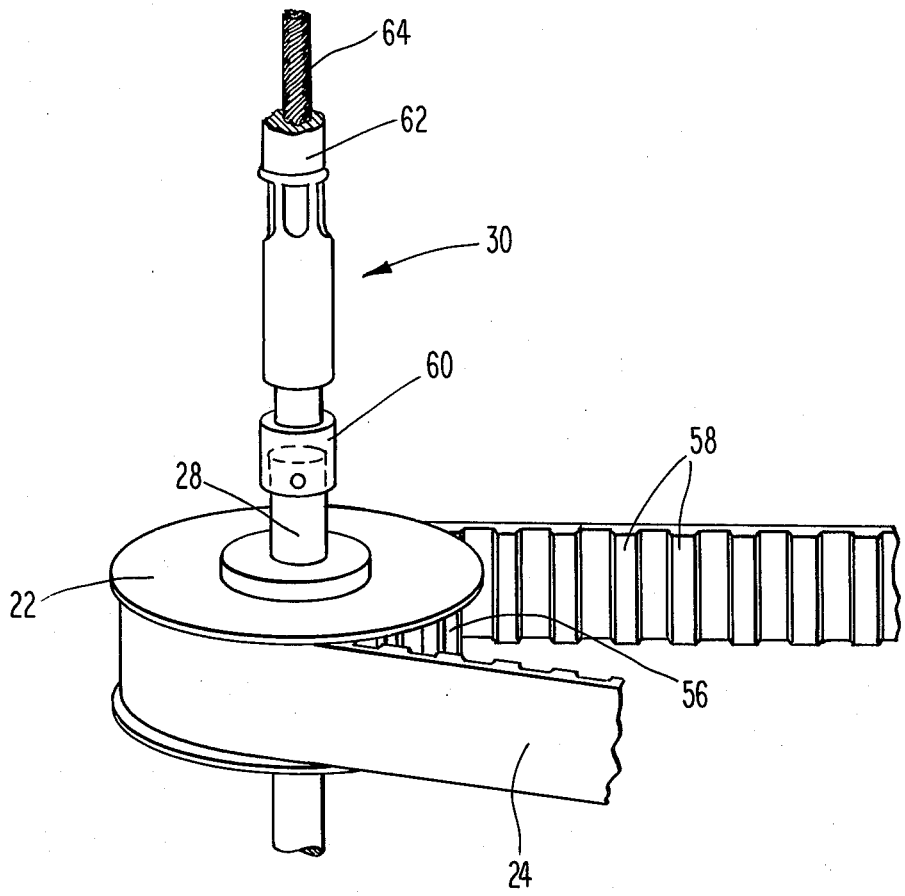
FIG. 2 is a perspective view of a portion of the steering mechanism illustrated in FIG. 1.

A housing 54, or suitable shrouding member, may enclose the pulley-timing belt mechanism to protect it from dirt, moisture, and the like, unless, or course, a self-contained unit as aforementioned is provided In FIG. 2, driven pulley 22 is provided with spaced teeth 56, as is driver pulley 20, and any other pulleys which may be employed in the system. Teeth 56 coact with spaced projections 58 on timing belt 24. Shaft 28 of driven pulley 22 is provided with a suitable end fitting assembly 60 which securely holds casing 62 of rotatable flexible shaft assembly 30, and permitting flexible shaft 64 to freely rotate within casing 62. Rotatable flexible shaft assembly 30 may be mounted to housing 54 by a suitable end fitting if additional rigidity of the pulley-belt-system is desired.

The invention is not intended to be limited to timing belt means for operably interengaging the pulleys. Those skilled in the art will appreciate that other suitable belt means, or chain-sprocket means, and the like, may be used advantageously with the present invention.

The screw of ball screw cylinder 36 is conveniently pitched at 0.750 inches. Thus, output member 42 will move 3 linear inches per single revolution of steering wheel 12 or driver pulley 20. From its mid-travel position, output member 42 can travel about 4½ inches in either direction, or a total of about 9 linear inches. Thus, three revolutions of steering wheel 12 will move output member 44 from position 50 to position 48, or vice versa.

It should be mentioned that the ball screw cylinder, rather than the steering wheel, absorbs the static load during steering of an outboard motor, for example. In push-pull steering systems, the static load applied to the outboard motor is transmitted directly to the steering wheel during the steering operation such that steering in one direction is assisted by the direction of rotation of the motor propeller. Steering in the other direction however is hindered or resisted by the propeller rotation. The difference in force required to steer the vessel in either direction is quite apparent and detracts from overall performance of the vessel. Further, the pounding feel of engine feedback and problems of constant correction of the steering wheel are substantially eliminated by the present invention.

Ball screw cylinder 36 may be provided with a double lead screw member, or the screw member may be provided with Acme conventional threads, or the like.

The pulleys may be made of polytetrafluoroethylene, nylon, polycarbonate, or other suitable plastic material, or from metals such as aluminum and the like.

The present invention may be used advantageously with stern drive units and inboard motors, as well as outboard type motors.

We claim:

1. In a marine vessel steering system wherein manually-operable steering control means effects rotation of rotatable flexible means for controlling movement of a steering member through screw means which converts rotary motion from said rotatable flexible means to linear motion, said linear motion effecting movement of said steering member which controls direction of travel of said marine vessel, the combination therewith of the improvement characterized by an absence of gear means between said manually-operable steering control means and said rotatable flexible means, said improvement comprising a driver pulley rotating in response to and accordance with rotation of said manually-operable steering control means, a driven pulley, belt means operably engaged about said driver pulley and said driven pulley whereby a single revolution of said manually-operable steering control means and driver pulley causes a plurality of revolutions of said driven pulley, said rotatable flexible means having one end thereof connected to an output of said driven pulley for rotation therewith and other end of said rotatable flexible means connected to said screw means.

2. The steering system of claim 1 wherein one revolution of said manually-operable steering control means and driver pulley produces 4 revolutions of said driven pulley.

3. The steering system of claim 2 wherein 4 revolutions of said driven pulley causes 4 revolutions of said rotatable flexible means and wherein said linear motion of said screw means is transmitted to an output member, said output member engaging said steering member, said output member travelling 3 linear inches in either direction from a mid-travel point with respect to said steering member in response to said 4 revolutions of said rotatable flexible means.

* * * * *